US007831058B2

(12) United States Patent
Chen

(10) Patent No.: US 7,831,058 B2
(45) Date of Patent: Nov. 9, 2010

(54) MICROPHONE POSITIONING STRUCTURE

(75) Inventor: Kuo-Chung Chen, Taipei Hsien (TW)

(73) Assignee: JDI Jing Deng Industrial Co., Ltd., Taipei Hsien (TW)

( * ) Notice: Subject to any disclaimer, the term of this patent is extended or adjusted under 35 U.S.C. 154(b) by 1113 days.

(21) Appl. No.: 11/506,793

(22) Filed: Aug. 21, 2006

(65) Prior Publication Data

US 2008/0013776 A1 Jan. 17, 2008

(30) Foreign Application Priority Data

Jul. 12, 2006 (TW) ..... 95212238 U

(51) Int. Cl.
*H04R 9/08* (2006.01)
*H04R 25/00* (2006.01)

(52) U.S. Cl. ..... 381/361; 381/374; 381/381

(58) Field of Classification Search ..... 381/361, 381/362, 364, 366, 367, 355, 370, 374, 376, 381/381, 382, 330, 322; 181/129; 379/430
See application file for complete search history.

(56) References Cited

U.S. PATENT DOCUMENTS 3,851,123 A * 11/1974 Lipinski et al. ..... 455/351

* cited by examiner

*Primary Examiner*—Tuan D Nguyen
(74) *Attorney, Agent, or Firm*—Muncy, Geissler, Olds & Lowe, PLLC

(57) ABSTRACT

A microphone positioning structure is connected to an audio output device, and is composed of a sound tube, an end of which is connected with the audio output device; an earplug part which is located at a tail end of the aforementioned sound tube; an ear-hook part, an end of which is connected with the aforementioned sound tube. An end of the sound tube is plugged into the audio output device such as a trumpet or a loudspeaker, the ear-hook part is hung on a user's auricle for positioning, and the earplug part is inserted into the user's ear. In addition, while listening, the ear-hook part is hung and fixed on the user's auricle; therefore, the earplug part will not be subjected to a force, and it will not be fallen off due to a force of gravity and a shaking.

6 Claims, 5 Drawing Sheets

MICROPHONE POSITIONING STRUCTURE

BACKGROUND OF THE INVENTION (a) Field of the Invention

The present invention relates to a microphone positioning structure, and more particularly to a microphone positioning structure wherein a microphone can be hung on a user's auricle to prevent an earplug part from being easily fallen off or broken and separated at a connection place of a sound tube, due to an excessive stretching from a careless usage.

(b) Description of the Prior Art

About 1700 years ago, an Italian scientist Torricelli brought up a concept that sound is propagating using air as a medium. Torricelli has thought using an experiment that a ring cannot be propagating in vacuum to prove his assertion. However, he could not accomplish his desire because the technique for creating the vacuum was not mature enough at that time. After that, a British physicist Boyle invented an air pump to create a vacuum to a container holding a bell, in order to carry out the experiment again; which has proven the concept brought up by Torricelli that any object which can make sound should be dependent on a vibration to generate a sound wave to be propagated through a medium.

Sound signals produced by an audio playing machine are outputted through an audio output device having a trumpet or loudspeaker. As the propagation of sound is scattered radiantly, if power of the audio output device is insufficient, the sound outputted will not be concentrated to achieve a best propagation efficiency, thereby easily dissipating the sound. Unless a user puts his or her ears to close to the audio output device, he or she will not be able to clearly listen the audio signals. If the power of audio output device is enlarged to allow the user to clearly receive the sound, the scattering of sound output of larger power will allow the surrounding non-users to receive the sound signals at the same time, resulting in some private sound signals of the user to be publicized to cause a trouble. Additionally, as the power of audio output device is too large, a pollution of noise will be created to the non-users, thereby interfering with other people's calmness.

To solve the aforementioned problems, there is a kind of microphone on the existing market, wherein an end of a sound tube is connected to an audio output device, and the other end of sound tube is connected with an earplug part to be sheathed into a user's ear. Therefore, when the user turns on the audio output device, sound waves generated from the audio output device will be concentrated and propagated in the sound tube, through an air vibration in the sound tube, and be directly entered into the user's ear through the earplug part for listening. During the process of transporting the sound waves, the sound waves are moved forward along the sound tube to specifically point to the target, without being scattered radiantly. Therefore, the sound outputted can be completely concentrated to achieve a best efficiency of sound propagation, and is provided with a high privacy without causing a pollution of noise to the non-users.

However, in practically using the aforementioned structure, as the earplug part is inserted into the user's ear, it can be fallen off or even broken and separated from a connection position of the sound tube due to excessively stretching the earplug part from a force of gravity, a natural shaking of user's body, or an abnormal pulling of the sound tube; which will cause a trouble in the usage to the user.

SUMMARY OF THE INVENTION

The primary object of present invention is to provide a microphone positioning structure which can be hung on a user's auricle to prevent from being fallen off or broken, thereby improving a quality of usage and prolonging a lifetime of usage.

Accordingly, to achieve the aforementioned objects, the present invention provides a microphone positioning structure which includes a sound tube, an end of which is connected with an audio output device; an earplug part which is located at a tail end of the aforementioned sound tube; and an ear-hook part, an end of which is connected with the aforementioned sound tube.

Accordingly to the aforementioned structure, an end of the sound tube is plugged to an audio output device such as a trumpet or a loudspeaker, the ear-hook part is hung on the user's auricle for positioning, and then the earplug part is inserted into the user's ear, such that the sound generated from the audio output device can be propagated to the earplug part through the sound tube to be listened by the user. In addition, while the user is listening, the ear-hook part is hung and fixed on the user's auricle; therefore, the earplug part is not subjected to a force, and will not be fallen off from a force of gravity or shaking.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
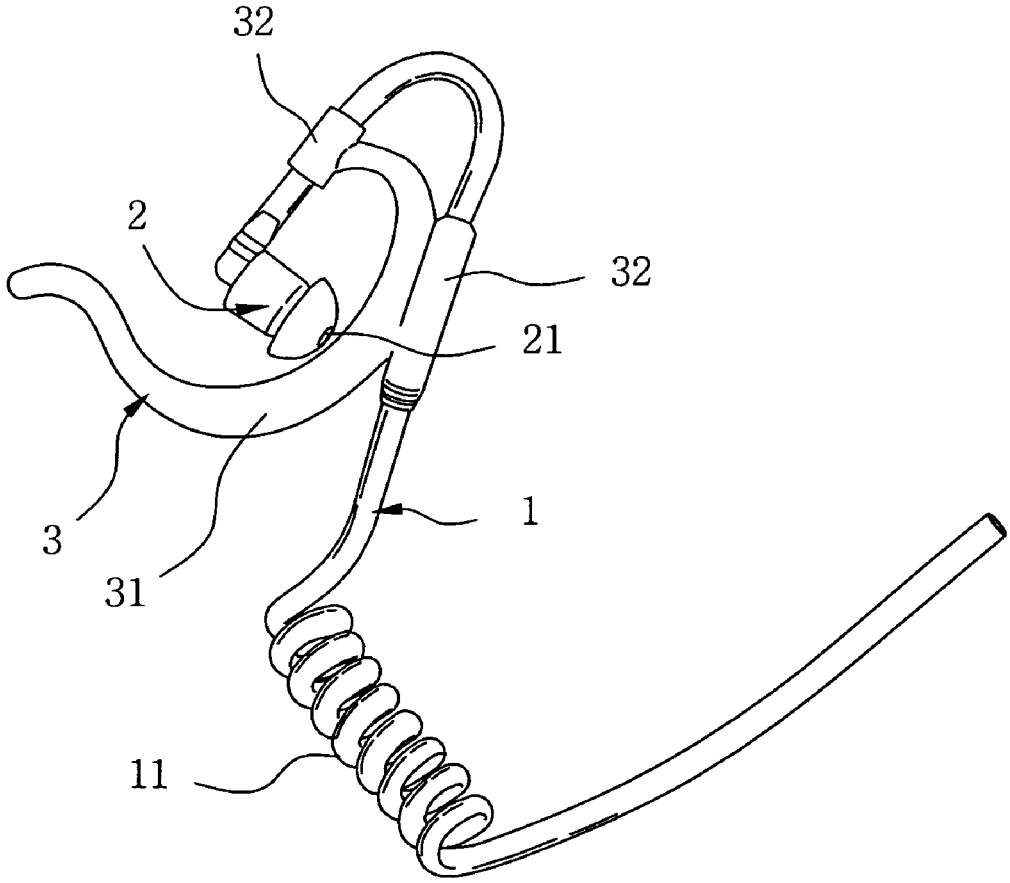
FIG. 1 shows a perspective view of the present invention.
Figure 2:
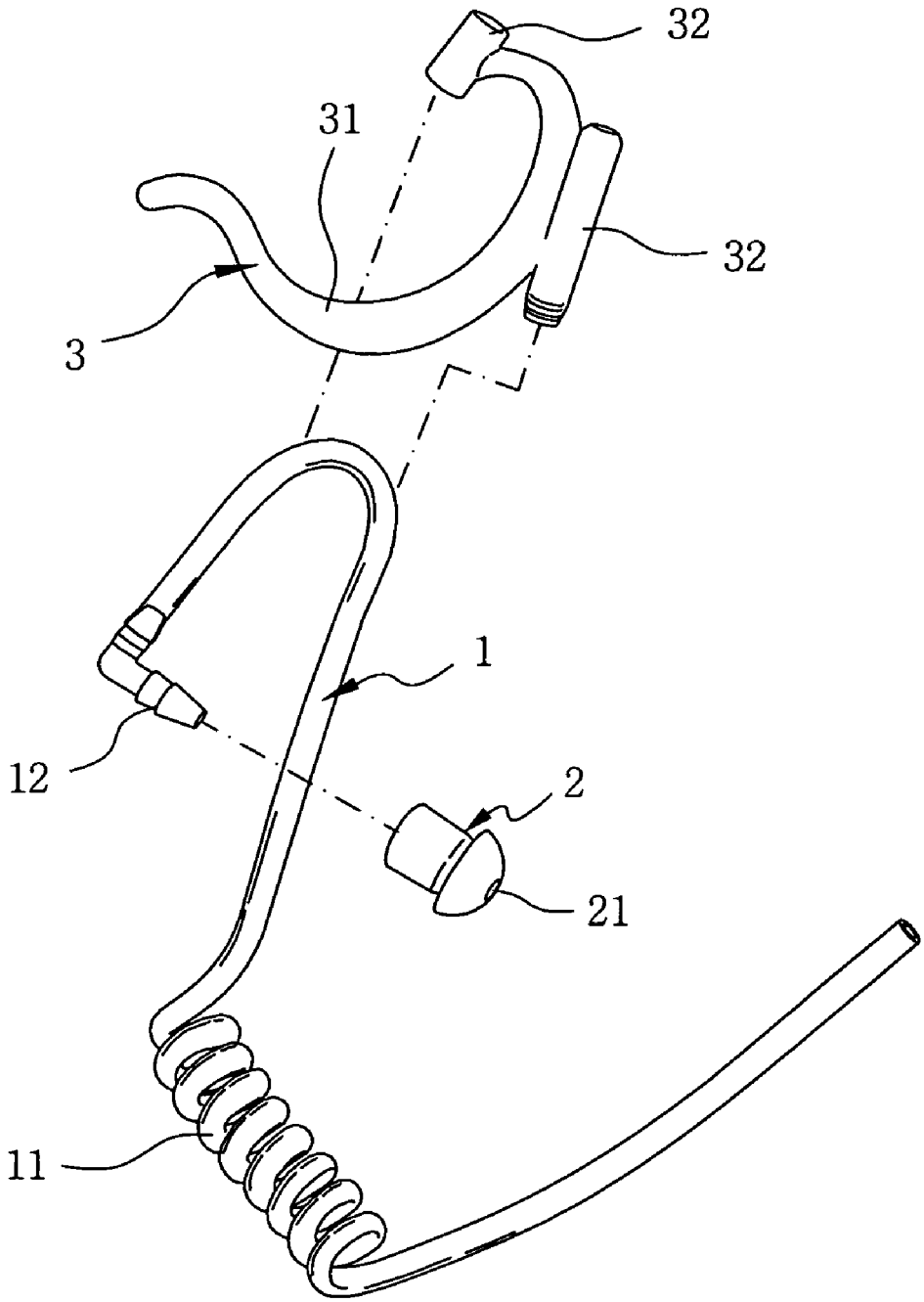
FIG. 2 shows an exploded view of the present invention.
Figure 3:
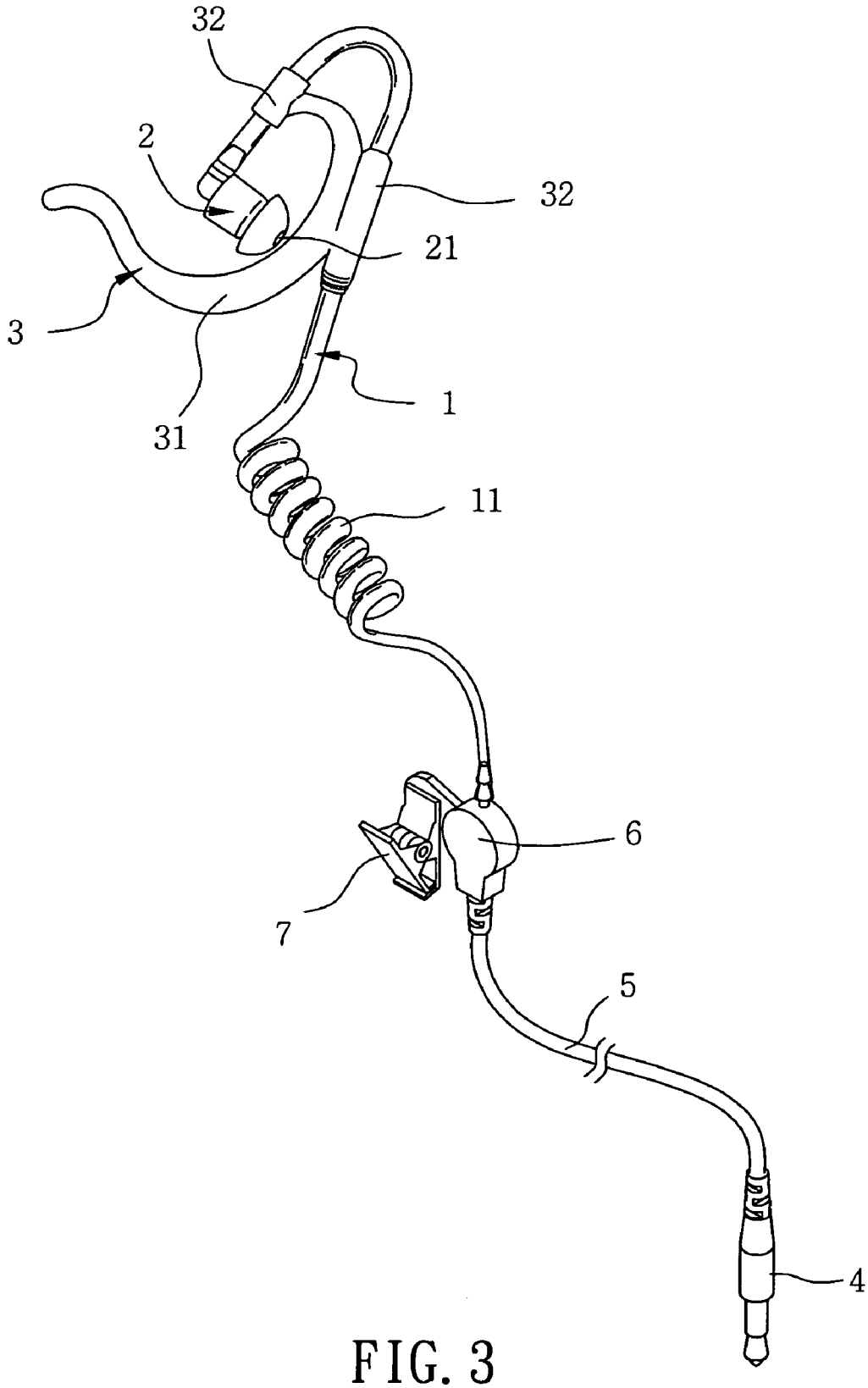
FIG. 3 shows a schematic view of an assembly of the present invention with an audio output device.
Figure 4:
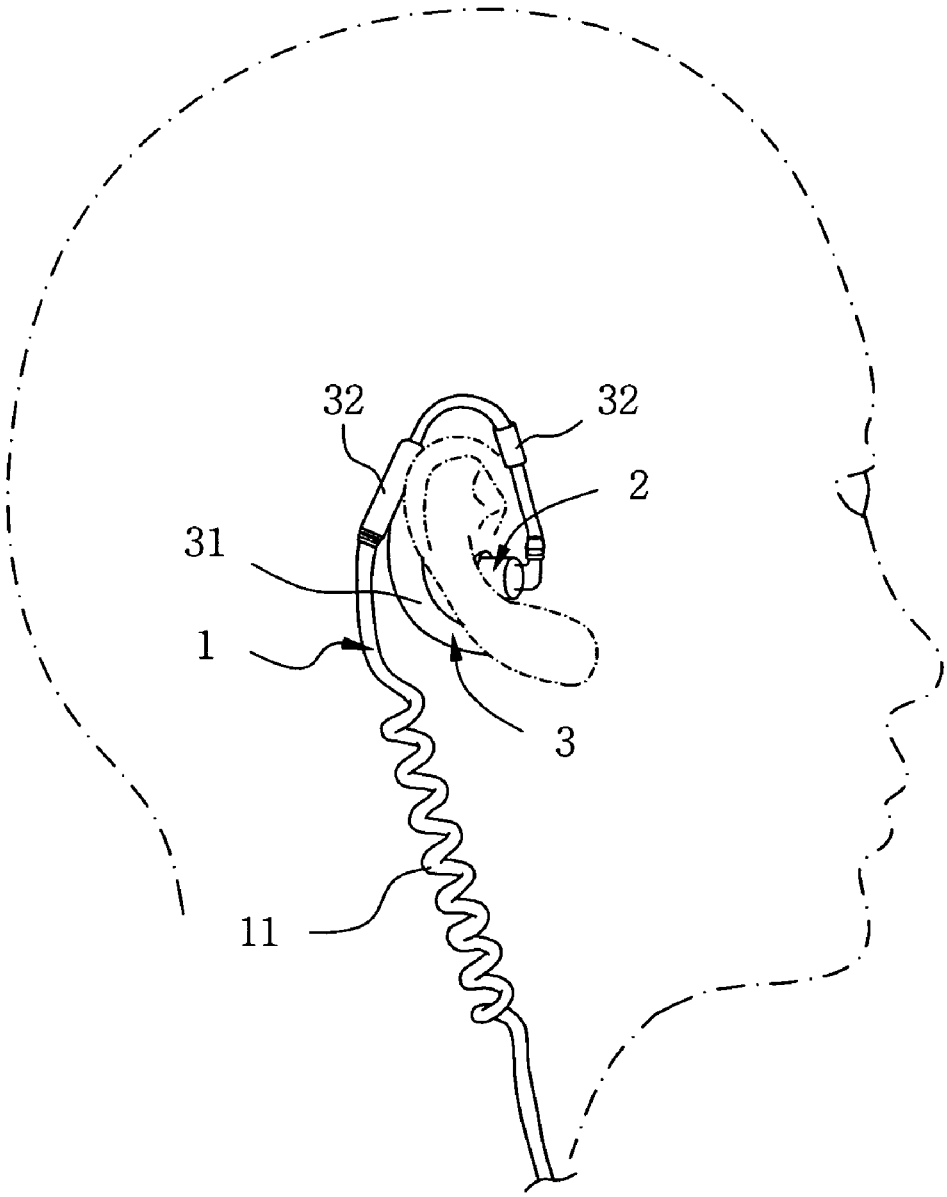
FIG. 4 shows a schematic view of an embodiment of the present invention.

Referring to FIGS. 1 to 3, the present invention is used to connect an audio output device which is provided with a connector 4 for connecting an audio playing machine. An end of the connector 4 is extended with a leading wire 5, and a tail end of which is provided with a speaker 6. In addition, a positioning clip 7 is located on the leading wire 5 for clipping on a user, to facilitate carrying and using.

The present invention includes a sound tube 1, an earplug part 2, and an ear-hook part 3. The sound tube 1 is made by a soft tube material, an end of which is connected with the speaker 6, a middle section of which is provided with an elastic helical tube 11 to be extended elastically, and an outer rim at a tail end of which is formed with a tenon 12. The earplug part 2 is correspondingly sheathed with the aforementioned tenon 12 at the tail end of sound tube 1, and an interior of the earplug part 2 is provided with a through-hole 21 to connect with the sound tube 1. The ear-hook part 3 is provided with a hanging device 31 which is fitted with a shape of human auricle, and two ends of the hanging device 31 are provided with a sleeve 32 respectively, to be correspondingly sheathed on the sound tube 1.

Referring to FIGS. 1 to 4, in implementing the aforementioned structure, an end of the sound tube 1 is first connected to the speaker 6 of audio output device, and the positioning clip 7 on the sound tube 1 is clipped on a user for fixing. When wearing the structure, the user adjusts a pitch between the two sleeves 32 at one end of the hanging device 31 on the sound tube 1 to control a tightness of the hanging device 31 for fitting a size and shape of the user's auricle, and then puts the hanging device 31 on his or her auricle, followed by inserting the earplug part 2 into his or her ear-hole for fixing. When the user is listening to sound messages, the sound will be outputted from the speaker 6, propagated along the sound tube 1, and finally entered into his or her eat through the through-hole 21 of earplug part 2. In using the structure, if the sound tube 1 is stretched by a natural shaking of the user's body or by accidents, a pulling force that the sound tube is subjected to is buffered initially through a deformation and stretching of the elastic helical tube 11, and then is transmitted to the hanging device 31 through the two sleeves 32 at one end of the hanging device 31, to be sustained by the user's auricle, without affecting the earplug part 2 in the user's ear. If the earplug part 2 gets loose in the user's ear, from a force of gravity or a shaking of user's head, it can be held due to the hanging device 31, without being fallen off along with the sound tube 1.

Figure 5:
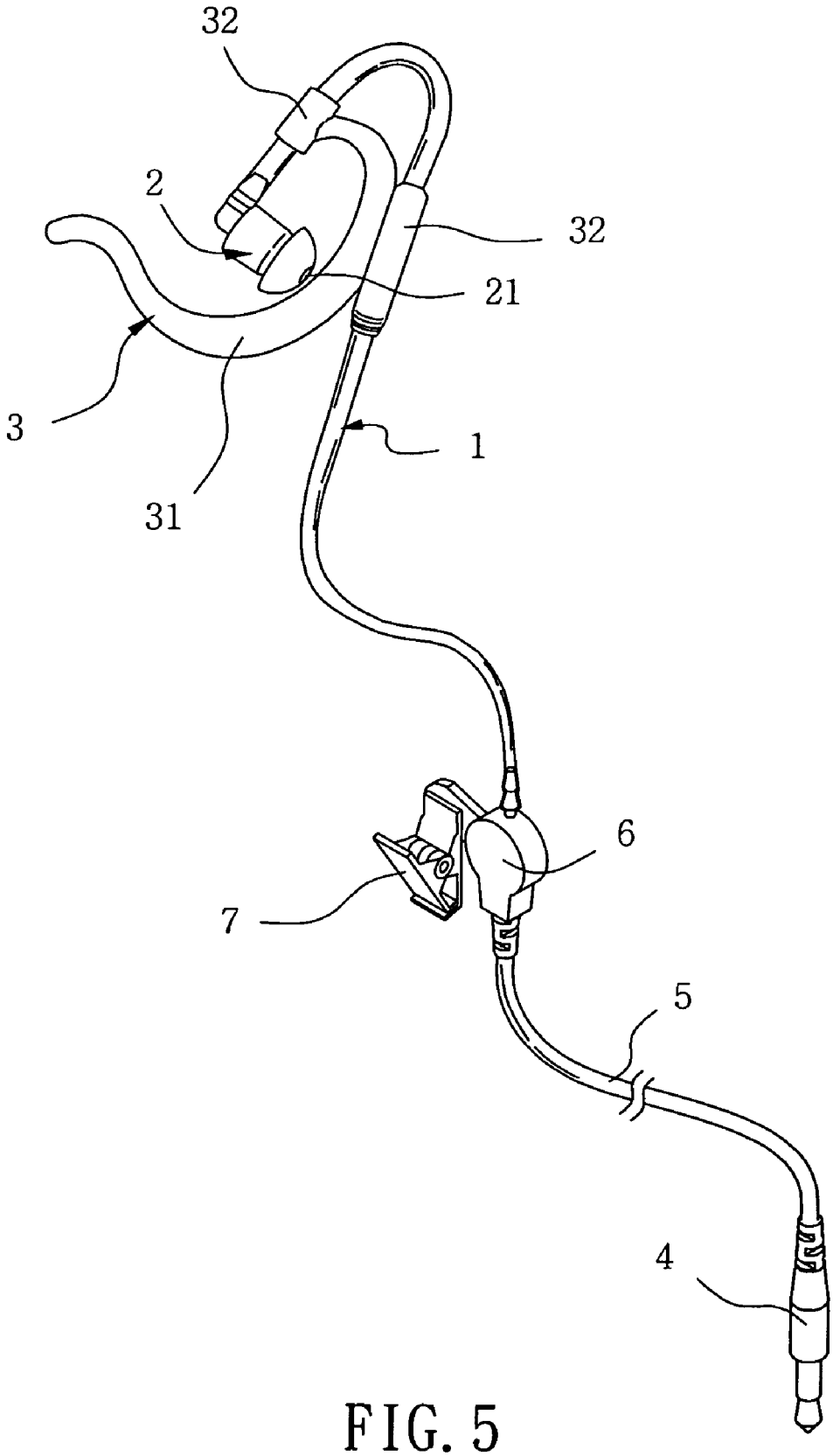
FIG. 5 shows a schematic view of a second embodiment of the present invention.

Referring to FIG. 5, it shows a second embodiment of the present invention. The sound tube 1 can be without the elastic helical tube 11 and is completely constituted by a straight tube. Therefore, the hanging device 31 will be used to sustain with the force resulting from the natural shaking of user's body and the pulling of sound tube 1, upon using the present invention.

Accordingly, the present invention is provided with the following advantages:

1. By putting the hanging device 31 on the user's auricle, the entire positioning can be enhanced, thereby increasing a quality of usage.

2. When the sound tube 1 is stretched, the pulling force that the sound tube 1 is subjected to can be transmitted to the hanging device 31 through the two sleeves 32 at one end of the hanging device 31 first, thereby preventing the earplug part 2 from being broken and separated at the position of connection with the sound tube 1 from the stretching, to prolong the entire lifetime of usage.

3. If the earplug part 2 gets loose in the user's ear, from the force of gravity or the shaking of user's head, it will not be fallen off with the sound tube 1 by the support of hanging device 31, thereby increasing the stability in wearing.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A microphone positioning structure, which is connected with an audio output device, comprising: a sound tube, an end of which is connected with the audio output device; an earplug part which is located at a tail end of the sound tube; and an ear-hook part, an end of which is connected with the sound tube; the ear-hook part being hung on a user's auricle for positioning, so as to prevent the microphone positioning structure from falling off due to shaking; the ear-hook being provided with a hanging device which is fitted with a shape of a human auricle, and an end of the hanging device being provided with at least one sleeve correspondingly sheathed on the sound tube.

2. The microphone positioning structure according to claim 1, wherein two ends of the hanging device are provided with a sleeve, respectively.

3. The microphone positioning structure according to claim 1, wherein the sound tube is provided with at least one section of elastic helical tube.

4. The microphone positioning structure according to claim 1, wherein the sound tube is made by a soft tube material.

5. The microphone positioning structure according to claim 1, wherein an outer rim at a tail end of the sound tube is formed with a tenon to be sheathed with the earplug part.

6. The microphone positioning structure according to claim 1, wherein the earplug part is provided with a through-hole for connecting the sound tube.

* * * * *